US007460957B2

(12) United States Patent
Prange et al.

(10) Patent No.: US 7,460,957 B2
(45) Date of Patent: Dec. 2, 2008

(54) GEOMETRICAL OPTIMIZATION OF MULTI-WELL TRAJECTORIES

(75) Inventors: Michael David Prange, Danbury, CT (US); Peter Gerhard Tilke, Belmont, MA (US); Clinton Dane Chapman, Missouri City, TX (US); Darren Lee Aklestad, Sugar Land, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 364 days.

(21) Appl. No.: 11/300,496

(22) Filed: Dec. 14, 2005

(65) Prior Publication Data

US 2006/0151214 A1 Jul. 13, 2006

Related U.S. Application Data

(60) Provisional application No. 60/636,076, filed on Dec. 14, 2004.

(51) Int. Cl.
*G01V 1/40* (2006.01)
*G06G 7/48* (2006.01)

(52) U.S. Cl. ..... 702/9; 703/5

(58) Field of Classification Search ..... 175/45; 702/1–12, 13, 14, 16; 703/5
See application file for complete search history.

(56) References Cited

U.S. PATENT DOCUMENTS 4,848,144 A 7/1989 Ho
5,220,963 A * 6/1993 Patton ..... 175/24
5,242,025 A 9/1993 Neill et al.
5,368,109 A * 11/1994 Pittard et al. ..... 175/45
5,667,023 A * 9/1997 Harrell et al. ..... 175/45
6,549,879 B1 4/2003 Cullick et al.
2003/0226661 A1 12/2003 Lima et al.
2004/0220790 A1 11/2004 Cullick et al.

FOREIGN PATENT DOCUMENTS

GB 2357097 A 6/2001
GB 2398900 A 9/2004

OTHER PUBLICATIONS

April, J., et al., Advanced Optimization Methodology in the Oil and Gas Industry: The Theory of Scatter Search Techniques with Simple Examples, SPE Hydrocarbon Economics and Evaluation Symposium, Dallas, TX, 2003, pp. 1-7, SPE 82009.

(Continued)

*Primary Examiner*—Michael P. Nghiem
*Assistant Examiner*—Toan M Le
(74) *Attorney, Agent, or Firm*—James McAleenan; Vincent Loccisano; Jody Lynn DeStefanis

(57) ABSTRACT

A novel method is presented to automatically design a multi-well development plan given a set of previously interpreted subsurface targets. This method identifies the optimal plan by minimizing the total cost as a function of existing and required new platforms, the number of wells, and the drilling cost of each of the wells. The cost of each well is a function of the well path and the overall complexity of the well.

19 Claims, 8 Drawing Sheets

OTHER PUBLICATIONS

Badru, O., et al., Well Placement Optimization in Field Development, SPE Annual Technical Conference and Exhibition, Denver, CO, 2003, pp. 1-9, SPE 84191.

Beckner, B. L., et al., Field Development Planning Using Simulated Annealing—Optimal Economic Well Scheduling and Placement, SPE Annual Technical Conference & Exhibition, Dallas, TX, 1995, pp. 1-13, SPE 30650.

Brown, A., AAPG Memoir 42 SEG Investigations in Geophysics, No. 9, Interpretation of Three-Dimensional Seismic Data, 1999, pp. 1-25, The American Association of Petroleum Geologists and the Society of Exploration Geophysicists.

Cullick, A. S., et al., Optimal Field Development Planning of Well Locations With Reservoir Uncertainty, SPE Annual Technical Conference and Exhibition, Dallas, TX, 2005, pp. 1-12, SPE 96986.

Cullick A. S., et al., Optimizing Multiple-Field Scheduling and Production Strategy with Reduced Risk, SPE Annual Technical Conference and Exhibition, Denver, CO, 2003, pp. 1-12, SPE 84239.

Gutteridge, P. A., et al., Connected Volume Calibration for Well-Path Ranking, European 3D Reservoir Modelling Conference, Norway, 1996, pp. 1-10, SPE 35503.

Guyaguler, B., et al., Optimization of Well Placement in a Gulf of Mexico Waterflooding Project, SPE Reservoir Evaluation & Engineering, 2002, pp. 229-236, SPE 78266.

Guyaguler, B., et al., Uncertainty Assessment of Well-Placement Optimization, SPE Reservoir Evaluation & Engineering, 2004, pp. 24-32, SPE 87663.

Johnson, R. A., et al., Applied Multivariate Statistical Analysis, 1982, pp. 555-560, Prentice-Hall, New Jersey.

Narayanan, K., et al., Better Field Development Decisions from Multi-Scenario, Interdependent Reservoir, Well, and Facility Simulations, SPE Reservoir Simulation Symposium, Houston, TX, 2003, pp. 1-11, SPE 79703.

Oag, A. W., et al., The Directional Difficulty Index—A New Approach to Performance Benchmarking, IADC/SPE Drilling Conference, New Orleans, LA, 2000, pp. 1-9, IADC/SPE 59196.

Press, W. H., et al., Numerical Recipes in C, The Art of Scientific Computing, 1992, pp. 408-410, Cambridge University Press, UK.

Ramakrishnan, T. S., et al., A Model-Based Interpretation Methodology for Evaluating Carbonate Reservoirs, SPE Annual Technical Conference and Exhibition, New Orleans, LA, 2001, pp. 1-15, SPE 71704.

Rothman, D., Automatic estimation of large residual statics corrections, Geophysics, 1986, pp. 332-346, vol. 51, No. 2.

Seifert, D., et al., Well Placement Optimisation and Risking Using 3-D Stochastic Reservoir Modelling Techniques, European 3-D Reservoir Modelling Conference, Norway, 1996, pp. 1-12, SPE 35520.

Yeten, B., et al., Optimisation of Nonconventional Well Type, Location and Trajectory, SPE Annual Technical Conference and Exhibition, San Antonio, TX, 2002, pp. 1-14, SPE 77565.

International Search Report and Written Opinion of the International Searching Authority for PCT/US2005/045266.

Gluyas, Jon and Richard Swarbrick, Petroleum Geoscience. 2004, Blackwell Publishing, Malden, MA, p. 3, Figure 1.1.

* cited by examiner

GEOMETRICAL OPTIMIZATION OF MULTI-WELL TRAJECTORIES

CROSS REFERENCE TO RELATED APPLICATIONS

This invention claims priority from U.S. Provisional Application No. 60/636,076 filed on Dec. 14, 2004.

FIELD OF THE INVENTION

The present invention relates to a method, system and apparatus for automatically designing a well development plan, and more particularly on the determination of an optimum plan by minimizing the total cost as a function of existing and required new platforms, the number of wells, and the drilling cost of each of the wells.

BACKGROUND OF THE INVENTION

Seismic and well log data is traditionally used to define and estimate the subsurface structure of reservoir bodies or target sites. Seismic and well log data can provide porosity, permeability, fluid and gas saturation data, as well as other reservoir properties, which is measured and computed at a high level of accuracy. These data are often plotted using a computer simulation such that the regions of interest are defined relative to various features, such as surface topography or reservoir production infrastructure. Based upon two-dimensional or three-dimensional plots of seismic data, a user will assess where to appropriately locate one or more surface well platforms to adequately access these subsurface regions using a variety of drilling methods. With advances in directional drilling, and subsurface positioning of these directional drilling tools, a single platform may be located to intersect a plurality of target sites. To date, the location of a platform is selected by an experienced user familiar with the constraints of directional drilling apparatus. For example, an experienced user would recognize the minimum turning radius (dogleg severity) of a directional drilling tool while computing the well paths from a surface platform to one or more target areas. Additionally, because the number of target areas identified using seismic data may be large, there exist numerous possible combinations of proposed well paths leading from a surface platform to one or more target areas. Each of these proposed pathways have a cost associated with the production of the well path, as well as a degree of difficulty that may be influenced by various factors such as topography or earth composition. Additionally, sub-optimal selection of well pathways, platform locations, or the total number of wells may have long lasting detrimental effects.

Conventional well planning techniques may include the use of computer simulations wherein a static computer model is generated which includes each proposed well. Following the location of a well within the static model various existing reservoir simulation techniques may be utilized to explore the proposed well location. This process is continuously repeated, with the introduction of additional well locations until a proposed "best" solution is generated. To date this is a highly unpredictable method of platform location, as the generated data set on which long term decisions is based is unnecessarily small. Furthermore, such a computational approach is processor intensive, and may take a long period of time for results to be generated.

Accordingly, a need exists to automate the optimization of multi-well trajectories leading from a surface platform to a variety of target areas.

SUMMARY OF THE INVENTION

Aspects and embodiments of the present invention are directed to the optimization of multi-well trajectories to yield the most beneficial location of platforms and wells orientated to reach a selected set of target locations. These target locations may include, but are not limited to, oil bearing formations, gas bearing formations, water bearing formations, or any combination thereof.

In accordance with one embodiment of the present invention a method for well path selection and optimization for subsurface drilling is recited. The method includes specifying a plurality of well-target locations. These well-target locations are accessible by a plurality of well paths. These well-target locations may be determined in view of subsurface seismic information or well-log information gathered in advance of the method recited herein. One skilled in the art will readily recognize that numerous existing technologies exist for identifying a select set of well-target locations, wherein these target areas contain a desirable resource such as oil, gas or water. Upon specifying a plurality of well-target locations, a well production value is associated with each of these target areas. This well production value may be based upon various data sources, such as proposed yield data determined by well simulation techniques, as well as various cost data and economic data. These various suitable data sources are evaluated to calculate an applicable well production value for each well-target location. Additional sources such as subsurface production constraint data and geohazard data may further be evaluated in assigning a well production value to the well-target locations. A variety of user defined well factors may additionally be utilized in associating a well production value with a well-target location. In light of well production value data, one or more well paths are generated, wherein these well paths are optimized for subsurface drilling. In one embodiment, the well development plan is optimized to produce well paths which maximize the value of the project, where project value is defined as the sum of well production values minus the sum of the various costs of drilling, platform location and building.

In an alternative embodiment, well production values need not be assigned to each well-target location. Instead of maximizing the total project value, the optimizer minimizes total project cost, where project costs include the various costs of drilling, platform location and building.

In an alternative embodiment, a system for well path selection and optimization is recited. This system includes a well-target-specifying element providing for the specification of a plurality of well-target locations, as well as a well production value generation element. The well production value generation element is capable of generating a well production value for each of said one or more wells associated with the well-target locations in accordance with the specification recited above. Furthermore, a first well path generation element is recited in the present embodiment, wherein this first well path generation element is capable of generating one or more well paths associated with the plurality of well-target locations using the well production values and well path data, wherein these generated well paths are optimized for subsurface drilling.

In an alternate embodiment, a computer program product, stored in a computer readable medium, which contains instructions to cause a computer to specify a plurality of well-target locations, wherein well-target locations are accessible by a plurality of wells, associate a well production value with each of the plurality of wells, and generate one or more well paths associated with said plurality of well-target locations using well production values and well path cost data such that an optimized path is produced. The computer program may additionally revise one or more well paths based on well production value data and well path cost data to generate a final well path optimized for subsurface drilling.

In an example of the present embodiment, the specification of a plurality of well targets may be based upon derived seismic data. In an embodiment, this specification of a number of targets may be based on recorded seismic data. Additionally, the association of a target value with each of these well-target locations may be based on numerous factors, including well simulation data, surface and sub-surface production constraint data, geohazard data or user defined factors. In accordance with the present embodiment, the generation of one or more well paths may further include the identification of the lowest cost optimized well path. This lowest-cost optimized well path may be viewed as the most beneficial well path for maximizing profits.

In an embodiment of the present invention, a method, system and computer program product stored in a computer readable medium is recited wherein a surface well location is first identified. This surface well location may include one or more well platforms. In accordance with this embodiment, a group of preliminary well paths originating at the surface well location and extending to a previously interpreted target are created. Additionally, each of these preliminary well paths is amended to yield a group of alternative well paths wherein the alternative well paths include multiple well targets associated with the alternative well paths. A well development plan is then calculated based upon the preliminary well paths and the alternative well paths, such that preliminary well path cost data and alternative well path cost data is utilized in creating the well development plan. In one embodiment this cost data may be based upon Directional Drilling Index data.

In accordance with this embodiment, the modifying of the group of preliminary well paths may include the adding of one or more well targets to each of the preliminary well paths to yield an alternative well path. Additionally, the cost of each alternative well path may be calculated following the addition of a well target to this path, such that comparisons can be made in cost data due to the addition of the well target. Furthermore, alternative well paths may be generated using an automatic trajectory planning element. In one embodiment, this automatic trajectory planning element is capable of providing constant curvature well paths through a series of well targets. In accordance with the present embodiment, the lowest-cost alternative well path may be identified, wherein this lowest-cost alternative well path represents a preliminary well path that has one or more well targets added to the preliminary well path to yield an alternative well path. Using this various alternative well path data, the location of the initial well surface location may be further optimized. For example, the locations of individual well platforms within the designated surface well location may be placed accordingly to optimize well path designations within the well development plan.

Additionally, an optimization element may be employed to effectuate the amending of a preliminary well path into an alternative well path. This optimization element may assign one or more well targets an anticipated surface well location. Additionally, one or more well platforms may further be assigned to the surface well location wherein these one or more well platforms are positioned in a calculated best location within the surface well location such that an optimized well path may be generated between the well platform location and the one or more targets. This optimization element may take numerous forms including the use of a Gibbs sampler. Additionally, a clustering algorithm may be used in assigning one or more well platforms to a surface well location and a Nelder-Mean algorithm may be used to optimize the location of well platforms.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE INVENTION

Figure 1:
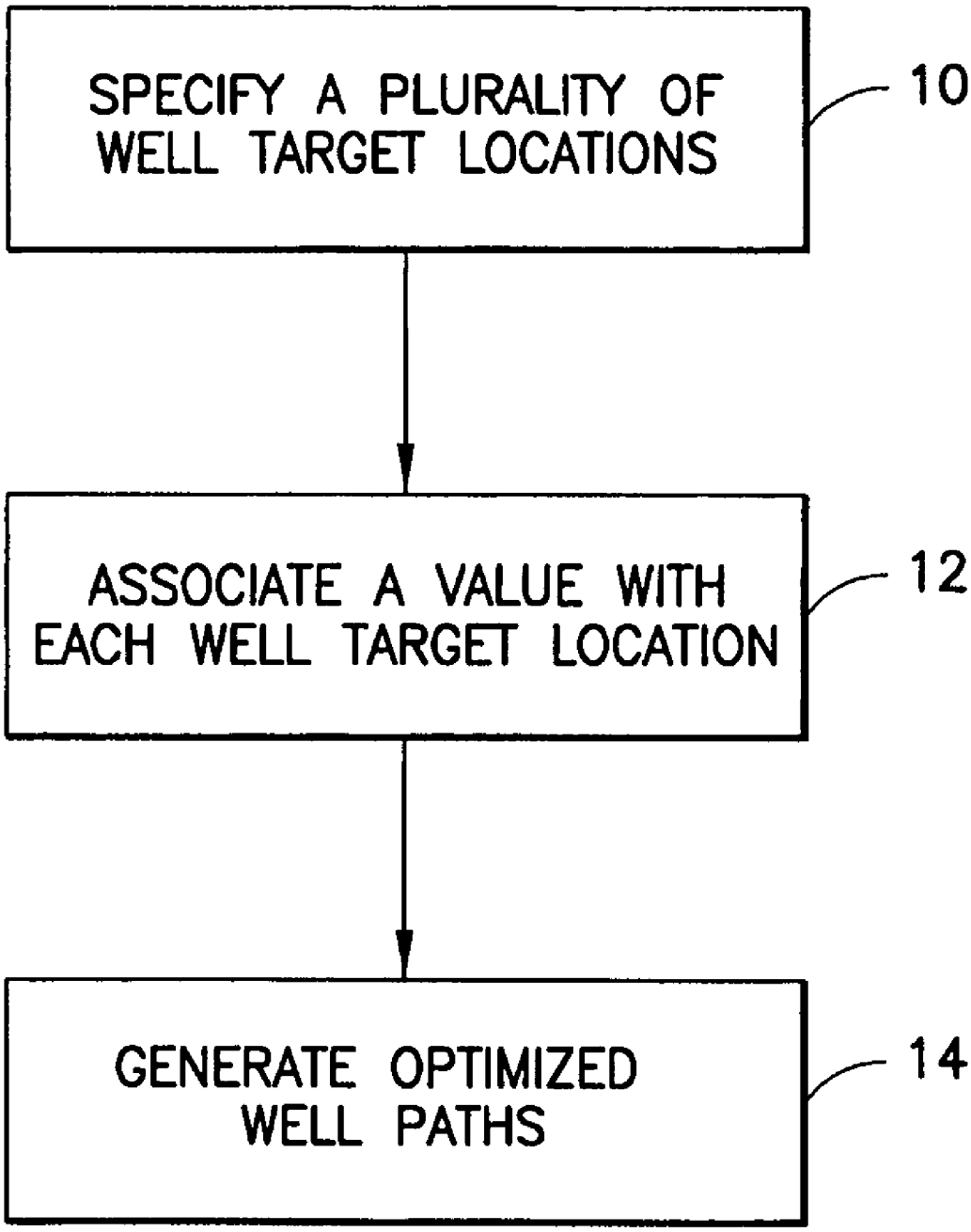
FIG. 1, is a flowchart illustrating the steps of one embodiment of the present invention.

Various embodiments and aspects of the invention will now be described in detail with reference to the accompanying figures. This invention is not limited in its application to the details of construction and the arrangement of components set forth in the following description or illustrated in the drawings. The invention is capable of various alternative embodiments and may be practiced using a variety of other ways. Furthermore, the terminology and phraseology used herein is solely used for descriptive purposes and should not be construed as limiting in scope. Language such as "including," "comprising," "having," "containing," or "involving," and variations herein, are intended to encompass both the items listed thereafter, equivalents, and additional items not recited.

As illustrated in FIG. 1, a flowchart illustrating the steps necessary in practicing an embodiment of the present invention is recited. In accordance with step 10 a plurality of well-target locations are first specified, wherein each of these well targets are accessible by one or more wells. The selection of well-target locations may occur using a variety of techniques, as understood by one skilled in the art. For example, well-target locations may be identified based upon derived or recorded seismic data obtained using a variety of techniques. For example, a surface seismic device such as described in the reference "Interpretation of Three Dimensional Seismic Data" by Alistair R. Brown, as published in the American Association of Petroleum Geologists Memoir 42, 1988 may be used with the present invention. One skilled in the art will readily recognize that numerous methods may be utilized in obtaining information for use in specifying a plurality of well-target locations, including but not limited to seismic information, well log information, or geological information derived from alternative sources.

Once well-target locations are specified in accordance with step 10, it is necessary to address how to produce these well-target locations in the most efficient manner. For the purpose of clarity, a lowest cost approach to producing well-target locations will be deemed the most efficient approach. One skilled in the art will recognize that the term "most efficient" may be addressed based on numerous criteria in accordance with the present invention, including maximized production, or maximized project value. In accordance with step 12 of the present embodiment, a well production value is associated with each of the wells. This well production value may be based on numerous data sources, and serves to quantify the proposed well-target location such that comparisons between well-target locations can be drawn. In one embodiment, well production values may be based, in whole or in part, on well simulation data. Appropriate well simulation data includes data generated in accordance with various simulation utilities, including the ECLISPE® simulation software packages offered by Schlumberger Technology Corporation of Sugar Land, Tex. A well production value in accordance with the present invention may also include numerous additional data sources, including but not limited to cost data associated with the well-target location as well as Directional Drilling Index (DDI) Data. Well production values may additionally incorporate surface and sub-surface production constraint data, as well as geohazards in the region of the well targets and proposed trajectories. Due to the uncertainty in directional drilling techniques, it may be necessary to evaluate positioning error of the drill string in lieu of subsurface geohazards such as fault lines when assigning a well production value associated with a well-target location. Additionally, other geohazards include salt bodies and fracture zones which can be delineated in the geological model. A 3 dimensional map of lithostatic (rock) pressure and fluid pressure can also be used to delineate hazardous areas of the subsurface due to phenomena such as overpressuring. In an effort to maintain an adequate distance from a geohazard such as a fault line, the resulting well production value of the well-target location may be modified to account for difficulty in reaching the well-target location using existing drilling techniques. Additional user defined factors may further be incorporated into the dataset utilized in generating a well production value wherein these individual user defined factors are appropriate to the conditions and environment. For example, the anticipated drilling tool may have restrictions on drilling speed, curvature of the wellbore, or life expectancy when operating in various environments. Each of these factors may be defined and incorporated into the assignment of a well production value with each well-target location.

In accordance with one embodiment of the present invention, design cost may be used as the objective function by which well production values are assigned and compared. In order for a well path from a well-target location to a platform to be useful as a comparative indicator, the cost function must include all significant cost-related well-design issues that are within the scope of the design plan being optimized. These design costs may include facilities costs such as cost per platform and cost per well slot, and also includes well costs that are related to well length, dog-leg severity, and the Directional-Difficulty Index (DDI).

The Directional Difficulty Index (DDI), as published A. W. Oag and M. Williams in the Society of Petroleum Engineers paper number 59196 provides a preliminary prediction of the relative difficulty in drilling a directional well. In accordance with the present invention, the DDI may be applied to one or more wells simultaneously and may be utilized in generating an estimated drilling cost per well.

The published equation for DDI is as follows:

$$a.\ DDI = \log_{10}\left[\frac{MD \times AHD \times Tortuosity}{TVD}\right] \quad (A.1)$$

where:

b. MD=Measured Depth c. TVD=True Vertical Depth d. AHD=Along Hole Displacement e. Tortuosity=Total curvature of borehole Typical values for directional wells range from 5.5 to 7.0. An analysis of a large number of wells yielded the results illustrated below:

TABLE 1

| DDI | Well Type | Proposed Cost Modifier |
|---|---|---|
| <6 | Relatively short wells. Simple profiles with low tortuosity. | −10% |
| 6.0-6.4 | Either shorter wells with high tortuosity or longer wells with lower tortuosity. | 0 |
| 6.4-6.8 | Longer wells with relatively tortuous well paths. | +5% |
| >6.8 | Long tortuous well profiles with a high degree of difficulty. | +10% |

In order to map DDI to estimated drilling cost, the results from Table 1 are approximated by a linear functional relationship:

$$a.\ Cost = Base \times [1 + Modifier \times (DDI - 6.4)] \quad (A.2)$$

where:

b. Cost=Final computed drilling cost of the well incorporating DDI, c. Base=Base computed drilling cost of the well based on rate of penetration and other drilling parameters, d. DDI=Computed DDI for well, e. Modifier=Multiplier to translate computed DDI to cost modifier. To approximately match results in Table 1, this value is set to 0.25.

In the implementation of (A.2), the modification to the base cost by DDI is constrained as follows:

$$\text{a. Modifier}\times(DDI-6.41)|\leqq 0.2 \tag{A.3}$$

This constraint prevents the DDI from unrealistically dominating the final cost function utilized in assigning a well production value. Local experience of an operator and the proposed conditions of the well(s) may additionally be factored into this formulation by adjusting the Modifier and 6.4 values in (A.2) and the 0.2 value in (A.3).

Following the association of a well production value with each well leading to a well-target location, one or more well paths may be generated, wherein these well paths are optimized for subsurface drilling. Optimization such as this may include the various techniques for use in determining the ideal well path(s) leading from a well platform to a well target. For example, in a multi-well design, the cost function recited above results in an estimate of the cost of implementing that particular plan. Consider a design with the set of platforms $P=\{P_1, \ldots, P_{Np}\}$, wells $W=\{W_1, \ldots, W_{Nw}\}$, and reservoir targets $T=\{T_1, \ldots, T_{Nt}\}$. Each reservoir target in T is a point in three-dimensional space through which a well must pass. Each well is composed of well segments that are either linear or arcs of circles. This is representative of how wells are planned today. Using an automatic trajectory planning algorithm capable of providing curvatures that attempt to minimize the complexity of a particular well by searching for complex geometric solutions to wells that do not meet preferred curvatures for individual segments results in the minimization of DDI.

Additionally, the generation of one or more well paths associated with the plurality of well-target locations, each of the well paths having a well production value may be further optimized using a variety of additional optimization techniques. For example, for well WI this list of individual segments may be expressed as $\{S_1^{(i)}, \ldots, S_{Ns}^{(i)}\}$.

Using optimization techniques in generating one or more optimized well paths, the present embodiment of the invention provides that each target in T will be intersected by a well path, such that each well path originates at one of the platforms in P, and that each platform is connected to no more than the maximum number of allowed wells paths for that platform. Maximum numbers of allowed well paths may be user defined, or controlled by software responsive to well factors such as anticipated flow, well path length and well diameter. Additional constraints such as various surface constraints, as well as the maximum number of available slots may also be used in conjunction with the present optimization techniques. One skilled in the art will recognize that numerous factors contributing to the maximum number of allowed well paths exist, and the list recited is not intended to be an exhaustive sampling of applicable factors. In light of such optimization of well path(s), the total cost $C_{total}$ of the design is given by the following three equations:

$$a.\ C_{total} = \sum_{i=1}^{N_p} C(P_i), \tag{1}$$

$$b.\ C(P_j) = C(platform) + DDI(W_i)\sum_{i=1}^{N_w} C(W_i), \tag{2}$$

-continued $$c.\ C(W_j) = C(well\ \ slot) + \sum_{i=1}^{N_s} C(S_i^{(j)}), \tag{3}$$

where the C(·) function returns the cost for that particular entity. The function C(platform) returns the fixed cost per platform before any wells are considered. While this cost may vary from platform to platform, it remains fixed for the purposes of generation one or more well paths leading from a platform to a well-target location. The function C(well slot) returns the fixed cost per well path on a platform before the costs of drilling are considered. While this function can vary from platform to platform and with the number of well paths on a platform, but has a fixed functional form throughout the generation of one or more optimized well paths. The function $DDI(W_i)$ returns a scaling factor derived from field practice which adjusts the drilling costs based on the geometrical complexity of a well path as recited in Equations A.1, A.2 and A.3.

One skilled in the art will recognize that the stated list of data utilized in assigning a well production value with a well path leading to a well-target location is not an exhaustive list and is solely utilized in illustrating some forms of applicable data used in target value computation. Various other factors, not herein recited, may further be utilized in assigning a well production value. Additionally, the present embodiment illustrates the generation of one or more well paths optimized for subsurface drilling based upon the cost function recited in Equations 1,2, and 3. While beneficial in illustrating one embodiment of the present invention, including the generation of one or more optimized well paths, one skilled in the art will recognize that the generation of optimized well paths may be based on numerous factors beyond the recited cost function. For example, an optimized well path may be generated in accordance with the present invention wherein the optimized well path yields the highest volume of product. As the present invention generally relates to all subsurface drilling operations, such an embodiment may prove beneficial when drilling for water for humanitarian reasons. In such a setting, maximized volume may prove more beneficial that minimized cost. A skilled artisan will therefore recognize that numerous optimized well paths may be generated wherein the optimized well path results in maximization or minimization of various aspects of subsurface wells. These various optimization means may be obtained by adequately defining the well production values of each of said plurality of well paths leading to a well target based upon the desired need. In an alternative embodiment, optimization in accordance to the present invention may include maximizing project value. In such an environment, the generation of well paths may include the removal of cost ineffective well targets from the list of available well targets if the expense of generating a well path to these well-target locations outweighs the predicted cost benefit of including them.

Figure 2:
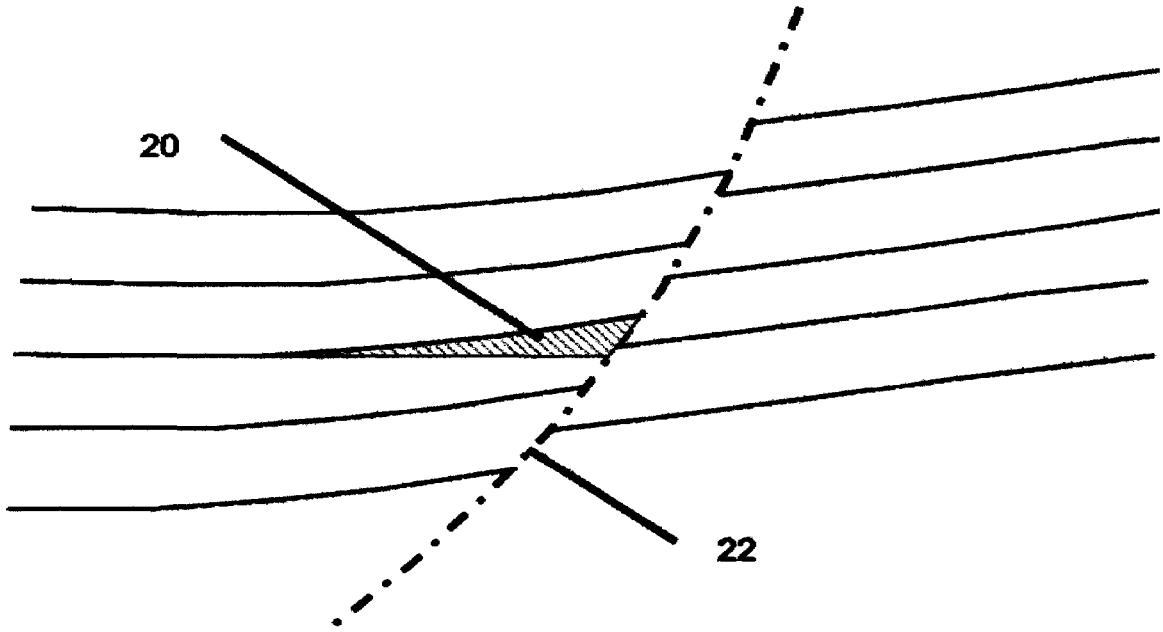
FIGURE 2 (PRIOR ART)
FIG. 2 is an illustrative example of applicable seismic data, as understood in the prior art, for use in defining well-target locations in accordance with an embodiment of the present invention

FIG. 2 is an illustrative example of applicable seismic data, as presented in a three dimensional model, for use in defining well-target locations in accordance with one embodiment of the present invention as understood in the prior art. Such subsurface seismic data may be obtained using a variety of techniques as understood by one skilled in the art. As illustrated in FIG. 2, a well-target location 22 is illustrated. This well-target location 22 may contain numerous products, such as natural gas, oil or water. Indication of the well-target location 20 may be illustrated by contrasting color or texture, as compared to areas surrounding the well-target location 20. In the present embodiment, subsurface geological data is further illustrated beyond the well-target location 20. For example, a geohazard such as a fault line 22 may be illustrated in a three dimensional display. A geohazard such as this may further have a safety region associated with it (not shown) wherein proposed well paths should not enter. For example, a 100 meter region surrounding a fault line 22 may be defined, wherein this region is to be avoided by any proposed well paths due to stability issues in the fault line region. One skilled in the art will recognize that numerous methods may be used in generating a seismic image and in identifying well-target locations. Well-target location may further be automatically generated based on seismic information, for example, or may be manually selected by a skilled user based on subsurface topography.

Figure 3:
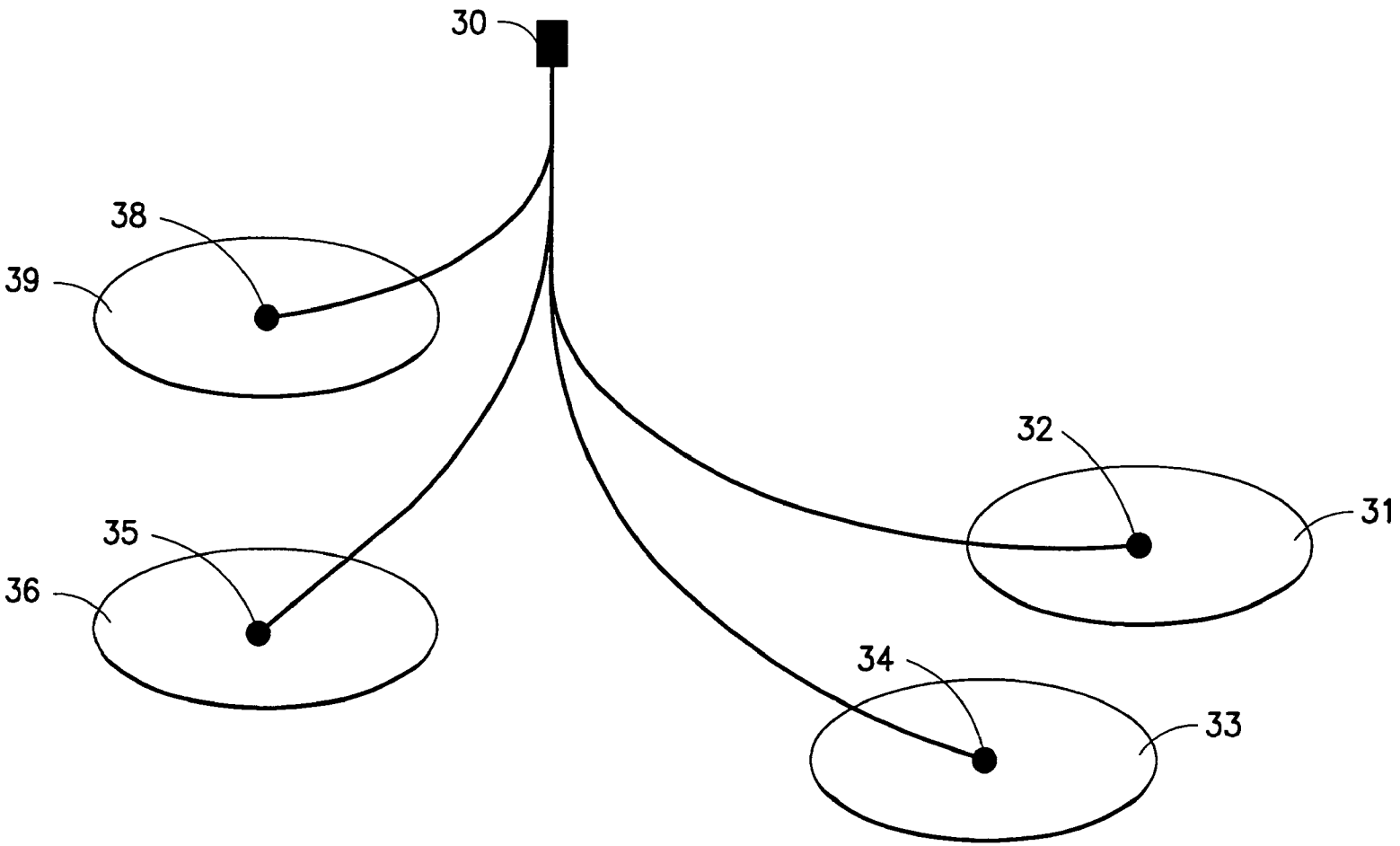
FIG.3 PRIOR ART
FIG. 3 is an illustration well path selection as understood in the prior art.

FIG. 3 is an illustration well path selection as understood in the prior art. In accordance with FIG. 3, a well platform 30 will be defined relative to anticipated well-target locations 32,34,36,38 that are positioned within reservoirs 31,33,35,39 determined to hold a desired product. For illustrative purposes, the present invention will be described relative to reservoirs containing oil, but one skilled in the art will recognize that various alternative reservoirs exist which are suitable for use with the present invention, including but not limited to natural gas and water bearing reservoirs.

In accordance with the present embodiment, as understood in the prior art, a well platform 30 is selected to include a plurality of wells extending from the platform 30 to each of the well-target locations 32,34,36,38. These wells may be traditional non-deviated wells, or may be wells drilled using directional drilling technology, as understood by one skilled in the art. Applicable directional drilling techniques include, but are not limited to PowerDrive rotary steerable systems and modular PowerPak steerable motors both of which are offered by Schlumberger Technology Corporation of Sugar Land, Tex.

Selection of well-target locations 32,34,36,38 may be user controlled, may be automated or may be some combination thereof. Existing well path generation typically generates an individual well path from the platform 30 to the well-target location 32,34,36,38, thereby resulting in multiple wells, each of which carries an associated cost for drilling. As these multiple wells may be in close proximity to more than one well-target location 32,34,36,38, an optimized well may drain multiple well-target locations. Selection of an optimized well location, however, is a difficult task which may result in various costs associated with the proposed well and various constraints. These costs and constraints will be addressed in greater detail below.

Figure 4:
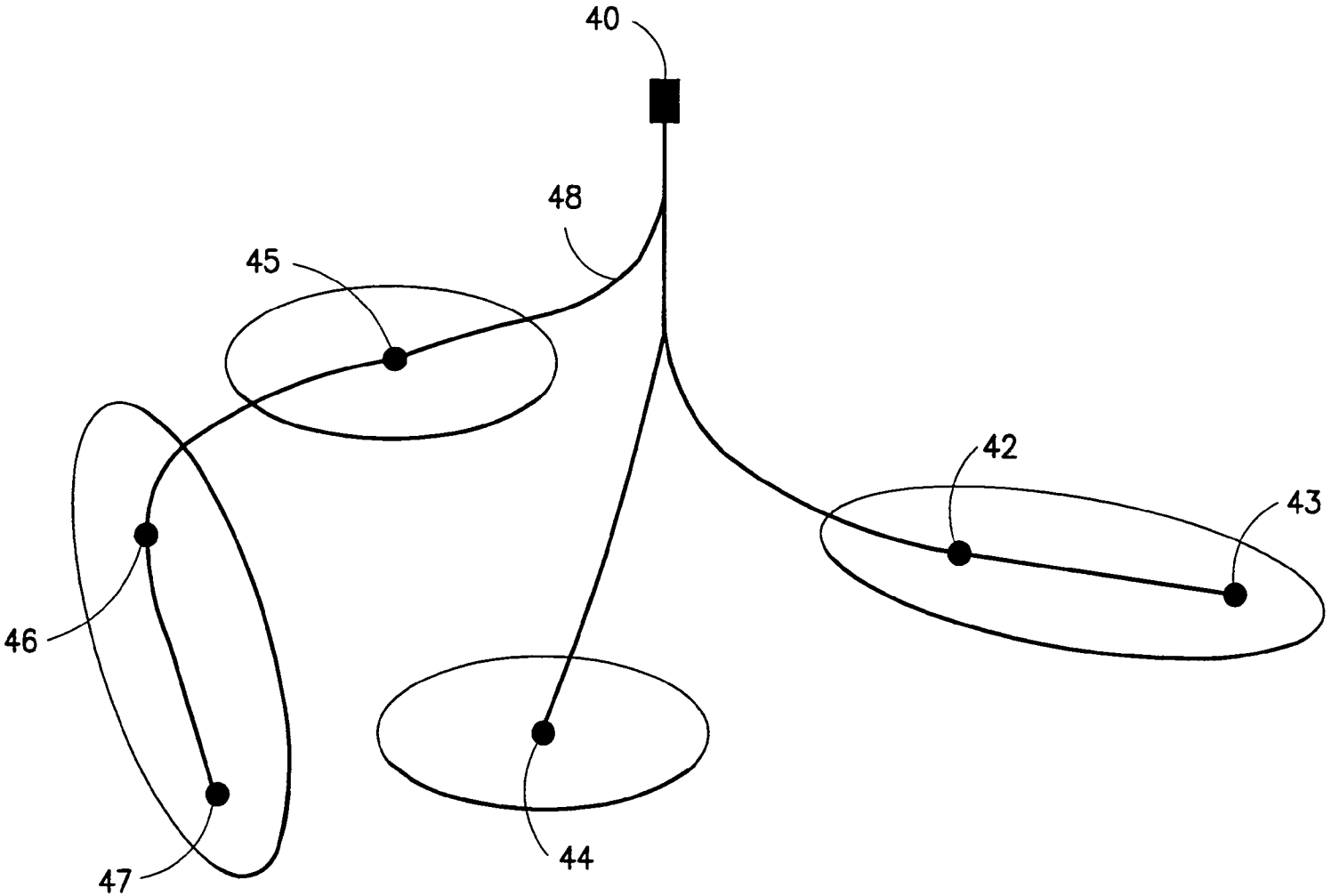
FIG. 4 is an illustration of a single platform which contains multiple wells, each of which drain multiple well-target locations.

FIG. 4 is an illustration of a single platform 40 which contains multiple wells, each of which drain multiple well-target locations 42,43,44,45,46. For the purpose of clarity, the multi target well 48 will be addressed, wherein this well produces well targets 45,46 and 47. Multi target well 48 may utilize directional drilling technology, thereby allowing control of well path direction such that multiple well-target locations may be reached. Using directional drilling technology, however, results in added complexity, as various permutations of proposed pathways spanning multiple well-target locations 45,46,47 may be generated. Additionally, directional drilling constraints such as dogleg severity, curvature, as well as the associated cost of each proposed multi target well results in numerous proposed solutions. Each of these solutions may satisfy the problem of reaching multiple targets with a single well path, but these proposed solutions are far from optimized. In one embodiment, an optimized well path will be a well path with a minimized the total cost. One skilled in the art will recognize that various other optimizations methods may be utilized, including maximized material recovery, or minimized well length. These are a non-exhaustive list of optimized well paths, as understood by one skilled in the art, and are not intended to be limiting in scope.

Figure 5:
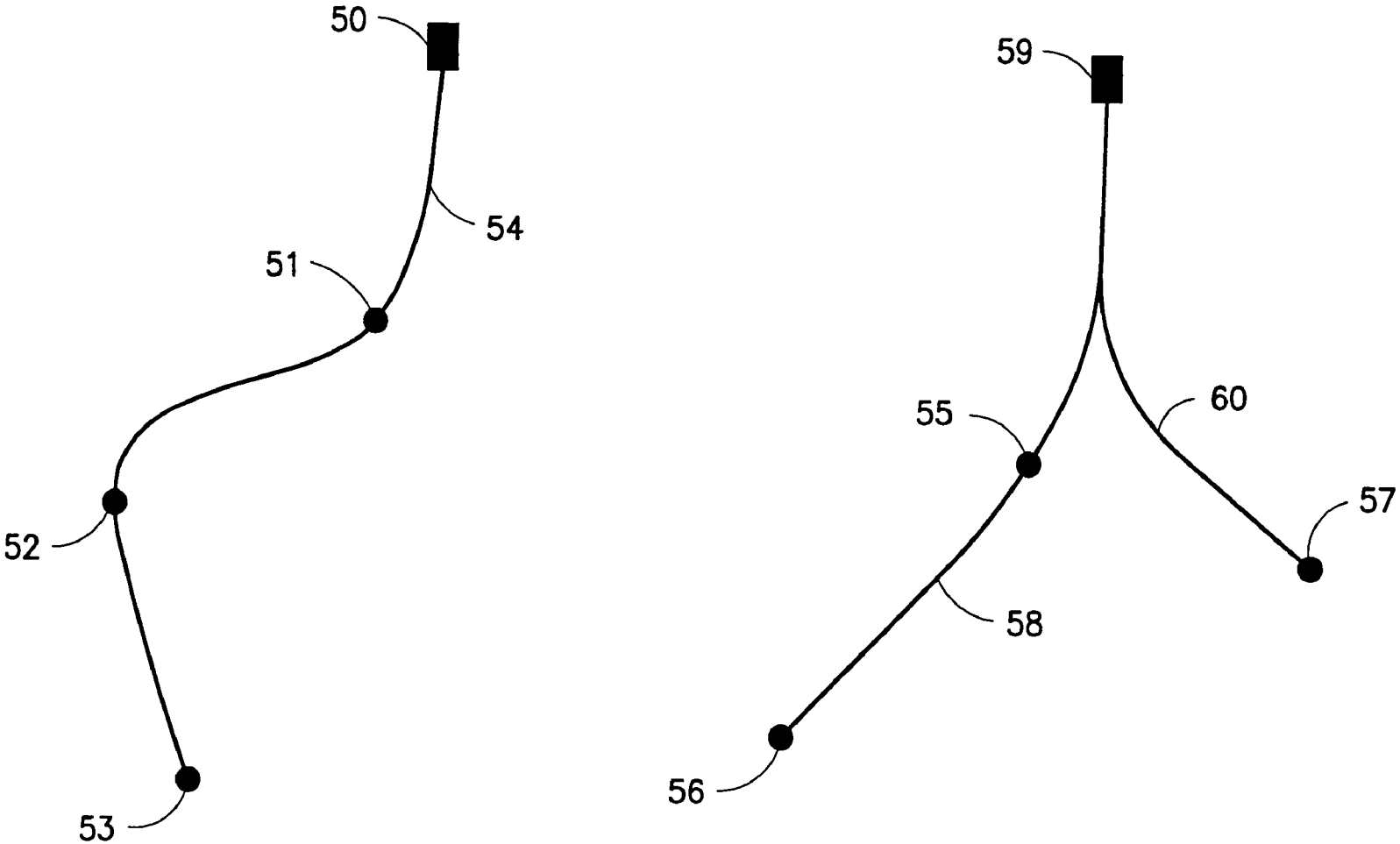
FIG. 5 is an illustration of multiple platforms which contain multiple wells, each of which drain multiple well-target locations.

In accordance with FIG. 5 of the present invention, the same optimization procedures for generating multiple target wells may be utilized for more than one platform 50, 59 within a proposed surface well location. As illustrated in FIG. 5, each platform 50,59 may have multiple well paths associated with the platform 54,58,60. For example, an optimized well path 54 for platform 50 may include well-target locations 51,52, 53. Additionally, an optimized well path 58 for platform 59, within the surface well location, may include well-target locations 55 and 56 on an individual well path. Furthermore, in view of the present optimization techniques applicable to the present invention, well-target location 57 is served by a single well path 60 leading from the platform 59 to the well-target location directly. This determination for a direct well path 60 is in lieu of the optimization technique used in evaluation the proposed target well locations 51,52, 53,55,56,57 in light of the well production values associated with each of the proposed wells leading to a well target. Well production values may include, but are not limited to, DDI data, well cost data, surface and subsurface production constraint data and geohazards in the regions surrounding the well-target locations. One skilled in the art will readily recognize that these are not an exhaustive list of suitable data for use is assigning well production values for each well leading to a well-target location.

Figure 6:
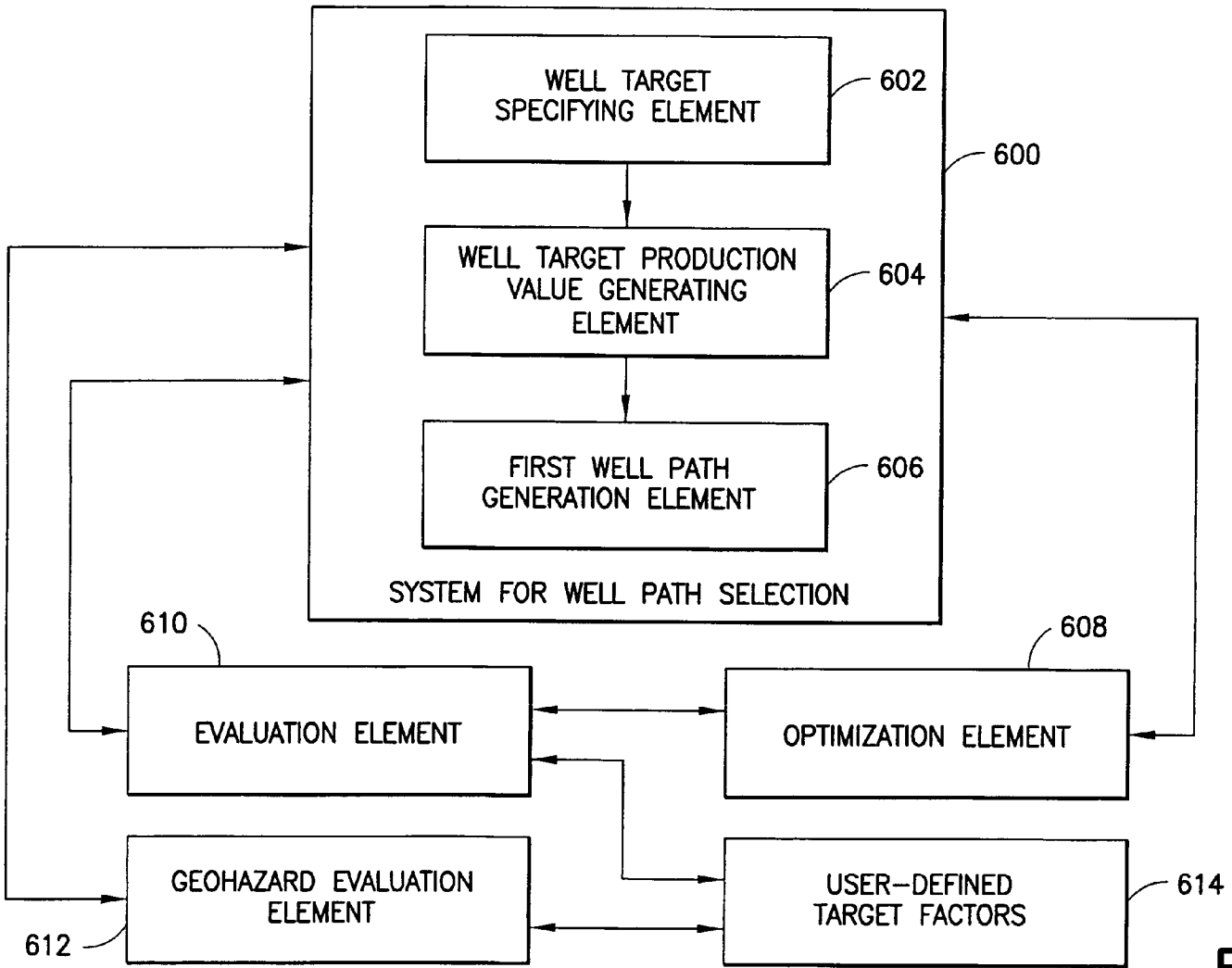
FIG. 6 is an illustrative example of the various components necessary in practicing an embodiment of the present invention.

FIG. 6 is an illustrative example of the various components necessary in practicing one embodiment of the present invention. In FIG. 6 a system for well path selection 600 is illustrated to contain a well target specifying element 602, a well production value generating element 604 and a first well path generation element 606. This proposed arrangement is used simply to graphically depict the interaction of elements within the system for well path selection 600 and is not intended to be limiting in scope or to illustrate the only suitable arrangement of elements. One skilled in the art will readily recognize that numerous alternative element may be added, subtracted, or combined with the system for well path selection 600 to yield a suitable system for practicing the present invention. The well-target specifying element 602 in the present invention may take numerous forms. In one embodiment, the well-target location specifying element 602 may automatically select suitable well-target locations based upon data provided to the well-target specifying element 602. For example, the well-target location specifying element 602 may automatically select regions in which oil likely collets in based upon seismic data. One skilled in the art will recognize that various regions may be selected and numerous forms of data may be used in adequately selecting these regions. The oil and seismic data example used herein is solely intended for illustrative purposes, and is not intended to be limiting in scope. In the alternative, a skilled user may manually selected well-target locations, using the well-target location specifying element 602, based upon data such as seismic data. Additionally, some combination of manual and automatic selection may be utilized in practicing the present invention. Each of the aforementioned well-target locations may be reached by one or more well paths leading from a platform location to the well targets, either directly or indirectly.

Upon specification of numerous well-target locations, a well production value generating element 604 is utilized in generating a well production value for each well that may lead to a well-target location. This target value generating element may base this assigned target value on numerous sources of information, including but not limited to well simulation data, well cost data, DDI data, surface and subsurface constraint data and geohazards in the well-target region. Additionally, user defined well factors may be utilized by the well production value generating element 604 in generating a well production value for each well path leading to a well-target location. One skilled in the art will recognize that this is not an exhaustive list of suitable data utilized in assigning a well production value to each well path, as suitable alternative data sources may be utilized in keeping with the scope of the present invention.

After the well production value generating element generates a well production value for each well-target location, a first well path generation element 606 generated a proposed well path for each well-target location. This proposed well path leads to one or more platforms. For illustrative purposes, a single platform with numerous well-target locations will be assumed. One skilled in the art will recognize that multiple well-target locations accessible by multiple platforms in a surface well location may exist. The present invention is intended to address such situations, but due to the complexity and volume of proposed computations, a single platform with multiple well targets will be detailed herein.

These first well paths generated by a first well path generation element 606 are optimized for subsurface drilling based upon well path data and well production value data generated by the well production value generating element 604. For clarity, optimization in accordance with the present embodiment will be viewed as minimized cost. One skilled in the art will recognize that "optimization" may take numerous alternative forms, including maximized production value or maximized material removal.

A minimized cost optimization proposal proves to be a computationally difficult task, as numerous local minima exist in the cost function. The only way to ensure that the globally lowest-cost solution has been found is by exhaustively searching the entire parameter space. Traditional well path simulation techniques have used a simulated annealing optimization method. Simulated annealing is a generalization of a Monte Carlo method based on the manner in which liquids freeze or metals recrystalize during annealing. During annealing a melt at a high initial temperature is disordered, and then slowly cooled so that the system remains in thermodynamic equilibrium at approximately all times. As cooling proceeds, a more ordered system results, and the system eventually approaches a "frozen" ground state at which point Temperature=0. In such a situation, annealing can be viewed as an adiabatic approach to the lowest energy state. In contrast, if the initial temperature of the system not high enough, or the cooling is accomplished at too rapid of a rate, defects may be formed (i.e. the system remains trapped in a local minimum energy state).

When applied to a computation problem as presented here, the thermodynamic state of the system undergoing annealing is analogous to the current solution to the optimization problem presented here. By comparison, the energy of the thermodynamic system is similar to the objective function, and a ground state can be viewed as the global minimum. Applying a simulated annealing technique to the present problem, care must be used in selecting initial temperature, number of iterations and in the avoidance of defects caused by an improper "annealing schedule."

Using simulated annealing with a maximum number of optimization iterations of 1000 and only 20 randomly located targets on a plane at depth, and in which the starting plan contained one platform and one well per target, resulted in the failure to find a plan better than the starting plan. In contrast, a better plan could usually be found by a skilled user through visual inspection in a few seconds. Results such as these highlight that simulated annealing approaches require a prohibitively large number of iterations (>>1000) to sample the solution space before they return practical results for problems of this complexity.

In light of such results, the present embodiment employs an alternative optimization technique. For illustrative purposes, this optimization technique may be controlled by an optimization element 608 in communication with the system for well path selection 600. As set forth prior, this optimization element is illustrated external to the system for well path selection 600, but one skilled in the art will readily recognize this arrangement is for illustrative purposes and that this element may be internal and/or external to the system for well path selection.

The optimization element 608 of the present invention may utilize a variety of applicable optimization techniques. For example, a variant of simulated annealing, called a Gibbs' sampler can be used to optimize the proposed well paths. Using this Gibbs sampler a sequence of samples from the joint probability distribution of two or more random variables can be generated, allowing for the approximation of the joint distribution, or the computation of an integral representing an expected value. Using a Gibbs sampler as a local optimizer allows for the generation of an instance from the distribution of each variable, wherein this is conditional on the current values of the other variables.

The optimization element 608 of the present embodiment allows for multiple aspects of well path selection to be addressed simultaneously. These multiple aspects may be divided into three parts, namely, the assignment of targets locations to well paths, the assignment of well paths to platforms, and the optimum positioning of the platforms. The target-assignment problem is solved using a Gibbs' sampler with the temperature set to zero. This provides a fast search for the locally-best assignment of well paths to target locations, while allowing the algorithm to explore distant regions of the search space one parameter at a time. One iteration step of the Gibbs' sampler with zero temperature works as follows. At the beginning of an iteration, each well path comprises an ordered subset of targets from the set T. Each iteration step performs the following operation once for each target in T. First target $T_i$ is randomly selected from T and removed from the well path containing it. If the containing well path has only that one target, the well path is deleted. Otherwise the well path comprises the remaining targets in their original order. Then target $T_i$ is iteratively placed in each interstitial slot in the list of target locations for each well path and the cost function returns the cost for that configuration. For example, target $T_i$ is first inserted as the first target in well $W_1$ and a cost is evaluated. Then it is removed from that slot and inserted as the second target in well $W_1$, and so on until it is inserted as the last target in the last well path $W_{Nw}$. As a final cost evaluation for this target, a new well path is created with target location Ti as its only target location. If the optimization is to maximize project value instead of minimizing project cost, an additional cost evaluation is needed which considers the well paths with the target $T_i$ excluded. Once the list of costs has been evaluated for each of the configurations for target location Ti, the lowest-cost configuration is selected for use as the starting point for the next target location. This evaluation proceeds until all target locations have been considered. The final state is the resulting state for this iteration. This process is then repeated for subsequent iterations until the solution remains unchanged between two iterations. This indicates that convergence is achieved. Typically fewer than ten iterations are required to reach convergence.

The assignment of well paths to platforms is solved using a clustering algorithm which first clusters the well paths and then assigns the well paths to a platform placed in each cluster. A k-means algorithm may be used in one embodiment of the present invention to perform this clustering. The k-means algorithm is an algorithm to cluster objects based on attributes into k partitions based on the assumption that object attributes form a vector space. Using this assumption, the k-means algorithm attempts to minimize total intra-cluster variance. The K-means function is represented as:

$$V = \sum_{i=1}^{k} \sum_{j \in S_i} |x_j - \mu_i|^2 \quad 1.$$

wherein there are k clusters $S_i$, i=1,2, . . . , k and $\mu_i$ is the centroid or mean point of all the points $x_j \in S_i$ Using the k-means function the well paths are partitioned into k initial clusters. Then each well path is assigned to the cluster whose centroid is nearest. As each well path is reassigned, the cluster centroids are recalculated. The process is repeated until no more reassignments take place. The cluster centroid is defined as the mean of the horizontal coordinates of the first target in each well in that cluster. Distance from a well path to a cluster is defined as the linear distance between the cluster centroid taken at the surface and the first target in the well path.

The final stage of optimization in accordance with the present embodiment may use a Nelder-Mean algorithm to optimally place each platform. This is a gradient-free optimizer. The objective function here is the cost function $C_{total}$. As set forth prior, this objective function $C_{total}$ may be replaced with various alternative functions representative of the proposed optimization criteria. This optimization adjusts the horizontal location of each platform without changing the well path assignments to each platform or the target location assignments to each well path. This optimization typically results in only small changes to the platform locations. It is done only in the final stage of optimization for two reasons, namely experimental tests have shown to have only negligible impact on the platform and well assignments versus using the cluster centroid for platform locations. Secondly, its relatively high cost would severely increase optimization runtime if included for every cost evaluation in the Gibbs' sampler.

In the present embodiment of the optimization element 608, integration of a local optimizer capable of receiving user guidance assists in rapidly guiding the user from their starting guess to an improved solution. This typically reduces the optimization time from days to seconds, and provides better solutions than "global" methods when computational runtime constraints limit the number of search steps to less than the burn-in period. At each step of the optimization the user is encouraged to refine constraints on target locations, well paths and platforms before continuing on to the next optimization. This provides the user with improved control over the optimization outcome. With increases in computer processing speeds, this user interaction may be eliminated such that presently computationally burdensome global approaches may be utilized exclusively.

Further associated with the system for well path selection 600 are various elements utilized in generating well production values by the well production value generation element 604. Illustrative embodiments include an evaluation element 610 capable of evaluating the proposed well path. Evaluations by the evaluation element may include, but are not limited to, DDI evaluations, well simulation data as well as specific constraint evaluations based upon the proposed drilling tool. Constraints such as these may be maximum borehole curvature, drilling speed and depth, and dog-leg severity. These aforementioned constraints are not an exhaustive list. Well simulation data may additionally be utilized by this evaluation element 610 to assess an appropriate well production value and well path. Additionally, a geohazard evaluation element 612 is in communication with the system for well path selection such that geohazards such as fault lines or regions of difficult drilling materials may be adequately avoided. This geohazard evaluation element 612 may utilized a variety of data sources such as user defined boundary condition or seismic data sources. Additionally, various user defined well production value factors 614 may be included during the generation of well production values by a well production value generating element 604 and the first well path generation element 606.

Figure 7:
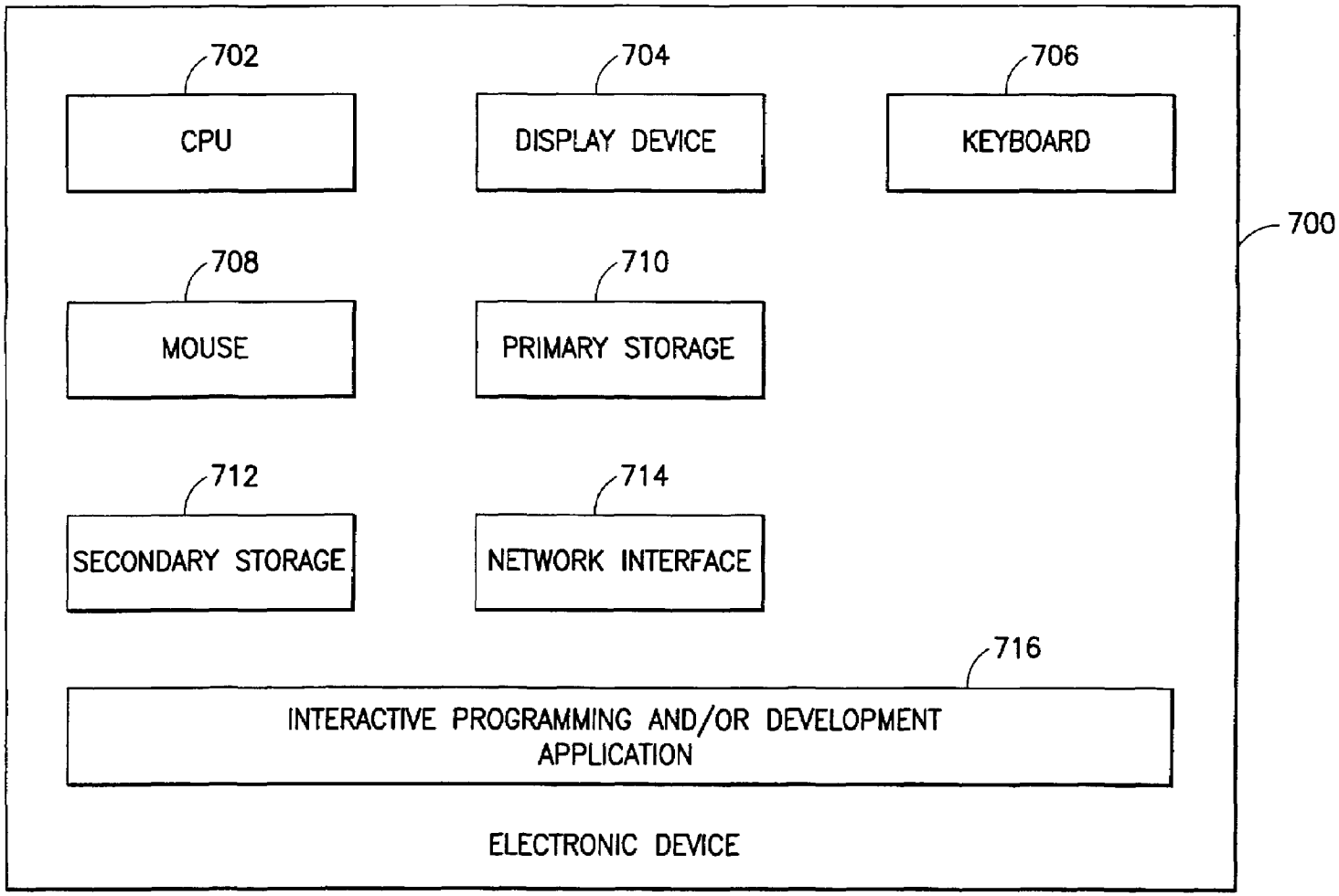
FIG. 7 is an illustration of one example embodiment of a suitable electronic device 700 for execution of a computer program product, stored in a computer readable medium, for use with the present invention.

FIG. 7 is an illustration of one example embodiment of a suitable electronic device 700 for execution of a computer program product, stored in a computer readable medium, for use with the present invention. The electronic device 700 is representative of a number of different technologies, such as personal computers (PCs), laptop computers, workstations, personal digital assistants (PDAs), Internet components, cellular telephones, and the like. In the illustrated embodiment, the electronic device 700 includes a central processing unit (CPU) 702 and a display device 704. The display device 704 enables the electronic device 700 to communicate directly with a user through a visual display. The electronic device 700 further includes a keyboard 706 and a mouse 508. Other potential input devices not depicted include a stylus, trackball, joystick, touch pad, touch screen, and the like. The electronic device 700 includes primary storage 710 and secondary storage 712 for storing data and instructions. The storage devices 710 and 712 can include such technologies as a floppy drive, hard drive, tape drive, optical drive, read only memory (ROM), random access memory (RAM), and the like. Applications such as browsers, JAVA virtual machines, and other utilities and applications can be resident on one or both of the storage devices 710 and 712. The electronic device 700 can also include a network interface 714 for communicating with one or more electronic devices external to the electronic device 700 depicted. A modem is one form of network interface 714 for establishing a connection with an external electronic device or network. The CPU 702 has either internally, or externally, attached thereto one or more of the aforementioned components. In addition to applications previously mentioned, modeling applications, well simulation applications and seismic interpretation applications can be operated on the electronic device 700.

It should be noted that the electronic device 700 is merely representative of a structure for implementing the present invention. However, one of ordinary skill in the art will appreciate that the present invention is not limited to implementation on only the described device 700. Other implementations can be utilized, including an implementation based partially or entirely in embedded code, where no user inputs or display devices are necessary. Rather, a processor can communicate directly with another processor or other device.

Figure 8:
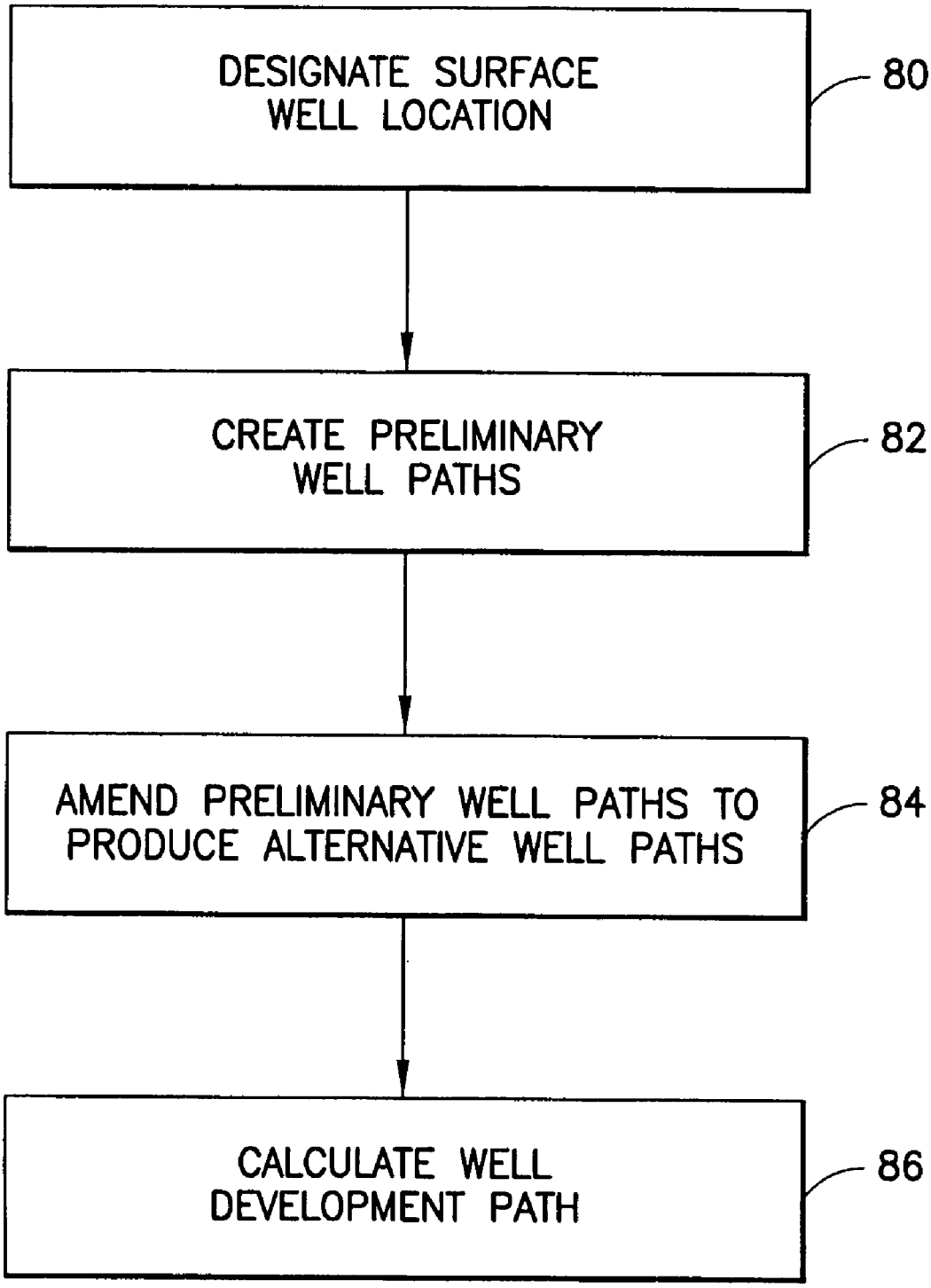
FIG. 8 is a flowchart illustrating the steps necessary in practicing an embodiment of the present invention

FIG. 8 is a flowchart illustrating the steps of an embodiment of the present invention. These steps may be practiced using a variety of techniques, including an electronic device recited in FIG. 7. In accordance with step 80, a surface well location is initially recited, wherein this surface well location may include one or more platforms. A group of preliminary well paths are then generated in accordance with step 82, wherein these preliminary well paths originate at the surface well location and extend to the previously interpreted well targets. The preliminary well paths are then modified to produce a group of alternative well paths, these well paths including multiple well targets associated with the alternative well paths (step 84). The modifying of the preliminary well paths may occur in a single step, or this may be an iterative approach to development of a group of alternative well paths. In one embodiment, the modifying of the preliminary group of well paths includes the step of adding one or more of the well targets to each of the preliminary well paths using an iterative approach. Additionally, the modifying of preliminary well paths to produce a group of alternative well paths may include the use of an automatic trajectory planning element. This automatic trajectory planning element capable of providing a trajectory using constant curvature (minimum curvature) well paths though a series of targets. For example, the automatic trajectory planning element can utilize an algorithm which provides curvatures that attempt to minimize the complexity of a particular well by searching for complex geometric solutions to wells that do not meet preferred curvatures for individual segments.

Finally, a well development plan is calculated (step 86) using the preliminary well path data and the alternative well path data such that the well development plan is based upon cost data derived from the preliminary well paths and the alternative well paths. The calculation of the well development plan of the present embodiment may utilize a variety of optimization techniques, including but not limited to the use of a lowest coast identifier approach. Using such an approach, the lowest cost alternative well path is identified, wherein these well paths may include a single well target or multiple well targets on a single well path. A lowest cost approach to well selection can utilize the optimization techniques recited herein, or may utilize alternative techniques as understood by one skilled in the art. Effectuating a lowest cost analysis may include the use of various data sources, including DDI data. Additionally, various other criteria may be utilized in calculating a well development plan including but not limited to extraction volume maximization.

In accordance with the present embodiment, the location of platforms within the designated surface well location may further be optimized using data from the proposed alternative well paths. Optimization of the location of platforms may utilize numerous applicable algorithmic techniques, including the recited Gibbs sampler, K-means algorithm, and Nelder-Mean algorithm. One skilled in the art will recognize this is not an exhaustive list, as numerous alternative algorithmic approaches are applicable to the present invention.

The present embodiment, as recited in the flowchart of FIG. 8 may be practiced using a variety of suitable techniques, including the use of a electronic device or system. Additionally, the method of the present embodiment may be reduced to a suitable computer program product, stored in a computer readable medium, which includes instructions cable of causing the computer to execute the method of the present embodiment.

The foregoing description is presented for purposes of illustration and description, and is not intended to limit the invention in the form disclosed herein. Consequently, variations and modifications to the inventive well path generation and optimization systems, methods and computer program products described commensurate with the above teachings, and the teachings of the relevant art, are deemed within the scope of this invention. These variations will readily suggest themselves to those skilled in the relevant oilfield, software, and other relevant industrial art, and are encompassed within the spirit of the invention and the scope of the following claims. Moreover, the embodiments described are further intended to explain the best mode for practicing the invention, and to enable others skilled in the art to utilize the invention in such, or other, embodiments, and with various modifications required by the particular applications or uses of the invention. It is intended that the appended claims be construed to include all alternative embodiments to the extent that it is permitted in view of the applicable prior art.

What is claimed is:

1. A method for well path designation of a well development plan based upon previously interpreted well targets, comprising the steps of:

designating a surface well location, said surface well location including one or more well platforms;

creating a group of preliminary well paths, said preliminary well paths originating at said surface well location and extending to said previously interpreted well targets;

modifying each of said group of preliminary well paths to yield a group of alternative well paths, said alternative well paths including multiple well targets associated with the alternative well paths; and calculating a well development plan using said preliminary well paths and said alternative well paths, wherein said well development plan is based upon cost data derived from the preliminary well paths and the alternative well paths.

2. The method of claim 1, wherein amending each of said group of preliminary well paths to yield a group of alternative well paths comprises adding one or more of said well targets to each of said preliminary well paths.

3. The method of claim 1, further comprising the step of identifying the lowest cost alternative well path following the addition of one or more of said well targets to said preliminary well paths.

4. The method of claim 1, wherein the step of modifying each of said group of preliminary well paths to yield a group of alternative well paths is accomplished by optimizing each of said groups of alternative well paths using an optimization element.

5. The method of claim 4, wherein said optimizing using an optimization element further comprises the steps of:

assigning one or more well targets to a surface well location;

assigning one or more well platforms to said surface well location; and positioning said one or more well platforms in a calculated best location.

6. A system for well path designation of a well development plan based upon previously interpreted well targets, comprising:

a surface well location designation element, said surface well location designation element capable of designating a surface well location including one or more well platforms;

a preliminary well path creation element, said preliminary well path creation element capable of creating a group of preliminary well paths, said preliminary well paths originating at said surface well location and extending to said previously interpreted targets;

an alternative well path generation element, said alternative well path generation element capable of modifying each of said group of preliminary well paths to yield a group of alternative well paths, said alternative well paths including multiple well targets associated with the alternative well paths; and a calculation element for calculating a well development plan using said preliminary well paths and said alternative well paths, wherein said well development plan is based upon cost data derived from the preliminary well paths and the alternative well paths.

7. The system of claim 6, wherein amending each of said group of preliminary well paths to yield a group of alternative well paths comprises adding one or more of said well targets to each of said preliminary well paths.

8. The system of claim 6, wherein the lowest cost alternative well path following the addition of one or more of said well targets to said preliminary well paths is identified.

9. The system of claim 6, wherein modifying each of said group of preliminary well paths to yield a group of alternative well paths is accomplished by optimizing each of said groups of alternative well paths using an optimization element.

10. The system of claim 9, wherein said optimizing using an optimization element capable of assigning one or more well targets to a surface well location, assigning one or more well platforms to said surface well location and positioning said one or more well platforms in a calculated best location.

11. The system of claim 6, further comprising a well production values association element, said well production values association element capable of associating well production values with each of the preliminary or alternative well paths.

12. The system of claim 6, wherein the well development plan is further based upon the well production values.

13. A computer program product for well path designation of a well development plan based upon previously interpreted well targets, said computer program product being stored in a computer readable medium, comprising instructions to cause a computer to:

designate a surface well location, said surface well location including one or more well platforms;

create a group of preliminary well paths, said preliminary well paths originating at said surface well location and extending to said previously interpreted targets;

modify each of said group of preliminary well paths to yield a group of alternative well paths, said alternative well paths including multiple well targets associated with the alternative well paths; and calculate a well development plan using said preliminary well paths and said alternative well paths, wherein said well development plan is based upon cost data derived from the preliminary well paths and the alternative well paths.

14. The computer program product of claim 13 wherein modifying each of said group of preliminary well paths to yield a group of alternative well paths comprises adding one or more of said well targets to each of said preliminary well paths.

15. The computer program product of claim 13, wherein the calculating of a cost for each of said alternative well paths following the addition of one or more of said well targets includes the calculation of a lowest cost alternative well path following the addition of one or more of said well targets to said preliminary well paths.

16. The computer program product of claim 13, wherein modifying each of said group of preliminary well paths to yield a group of alternative well paths is accomplished by optimizing each of said groups of alternative well paths using an optimization element.

17. The computer program product of claim 16, wherein said optimizing using an optimization element further includes the:

assigning of one or more targets to a surface well location;

assigning one or more well platforms to said surface well location; and positioning of said one or more well platforms in a calculated best location.

18. The computer program product of claim 13, further comprising instruction to cause a computer to associate well production values with each of the preliminary or alternative well paths.

19. The computer program product of claim 13, wherein the well development plan is further based upon the well production values.

* * * * *